United States Patent [19]

Hotta et al.

[11] 4,311,461

[45] Jan. 19, 1982

[54] DENTAL TREATMENT CHAIR SYSTEM

[75] Inventors: Mitsuhiko Hotta, Kyoto; Minoru Watanabe, Shinnaka, both of Japan

[73] Assignee: Kabushiki Kaisha Morita Seisakusho, Kyoto, Japan

[21] Appl. No.: 197,087

[22] Filed: Oct. 15, 1980

[30] Foreign Application Priority Data

Oct. 16, 1979 [JP] Japan ..... 54/133941

[51] Int. Cl.[3] ..... A61G 15/00

[52] U.S. Cl. ..... 433/33; 297/191

[58] Field of Search ..... 433/33, 79, 78; 297/191

[56] References Cited

U.S. PATENT DOCUMENTS

| | | | |
|---|---|---|---|
| 365,859 | 7/1887 | Porter | 433/79 |
| 3,198,574 | 8/1965 | Sadayasuota et al. | 433/33 |
| 3,259,430 | 7/1966 | Beach | 433/33 |
| 3,386,766 | 6/1968 | Gorelick | 433/33 |
| 3,552,019 | 1/1971 | Crapanzano | 433/78 |
| 3,596,987 | 8/1971 | Wilson | 297/191 |
| 3,813,147 | 5/1974 | Rick | 297/191 |
| 4,114,273 | 9/1978 | McGaha | 433/78 |
| 4,249,900 | 2/1981 | Hoelzer et al. | 433/79 |

OTHER PUBLICATIONS

"Century Uni-Chair", from A-dec, ad, 1976.

*Primary Examiner*—Robert Peshock
*Assistant Examiner*—John J. Wilson
*Attorney, Agent, or Firm*—Koda and Androlia

[57] ABSTRACT

A dental treatment system comprising a treatment chair seat, a backrest mounted tiltably thereto, and a headrest characterized in that the device includes a unit box assembly adapted to be stored inside or underside the backrest and to be drawn out therefrom. The unit box assembly having a variety of instruments housed therein is designed such that the instruments may be positioned in the space on the shoulder of the backrest or on the side of the headrest or on both of the shoulder and the side because of the construction of the assembly that, when the box assembly is stored in the backrest, it may be interlocked with the tilting of the backrest and, when drawn out therefrom, may be freely moved, stopped, vertically and bilaterally rotated and stopped independently of tilting the backrest to thereby facilitate handling of the instruments and to save additional space for separate arrangement of instruments.

6 Claims, 19 Drawing Figures

DENTAL TREATMENT CHAIR SYSTEM

BACKGROUND OF THE INVENTION

1. Field of the Invention

This invention relates generally to a dental treatment chair system and more particularly to a dental treatment chair system which makes it possible to suitably change the direction in which to manipulated a dental instrument in accordance with the position and type of treatment a patient undergoes and with the position and posture the operator takes during a particular treatment.

2. Prior Art

In dental treatment, it is considered essential for optimum treatment, to change the direction in which an operator manipulates an instrument in accordance with the purpose of treatment, the oral region being treated and the position and posture of the operator. Accordingly, there have been many ideas as to where the instruments should be disposed with reference to a treatment device. A description will now be given roughly outlining the problems in conventional devices of this nature, which have not yet been solved.

In similar types of conventional devices, Type (a) features instruments which are directly mounted to a backrest freely tiltable with respect to the seat of a treatment chair; Type (b) features instruments which are mounted to a tray table or tray arm; Type (b-2) features instruments which are mounted to a spittoon portion and Type (b-3) features instruments which are mounted to a movable cart, etc. The types of conventional devices described above have both pros and cons. In particular, Type (a), in which the instruments are directly mounted to the backrest, is much more functional. Type (a) is more functional because it enables the assembly of flexible connection pipes connected to the instruments, stores the pipes inside the backrest with the pipes out of view and dispenses with a long arm and an exposed support which are provided independently of the chair device, saving such sagging exposure of the flexible connection pipe being provided with a tray and a spittoon and further increases manipulability of the instruments without forced posture on the part of the operator, enhances the outer apperance of the invention and does not cause the patient to feel wariness or terror. The present invention is an improvement over Type (a) and a description will now be given of the present invention with reference to the prior art of Type (a) and also in conjunction with its inherent problems, which have not yet been solved.

The device of Type (a) (of the Prior Art) is designed so that the instruments are detachably mounted either to the shoulder of a backrest, to the side of a headrest or to both the shoulder and side (Japanese Pat. No. 444,604, equivalent of U.S. Pat. No. 3,198,574). The device of Type (a) is advantageous in that the operator is seated during treatment of a patient and is relieved of the trouble and effort of pushing himself onward or twisting himself to reach an instrument irrespective of whether the instruments are mounted on the right or left side of the treatment chair, thus making treatment more efficient and lessening the fatigue on the operator. But this design is still problematic in that during the treatment activity in a seated position of 9 to 12 o'clock the flexible connection pipe entwines around the operator's hand and obstructs his field of vision thereby interfering with the treatment activity, as will become apparent from a description to be given presently.

SUMMARY OF THE INVENTION

In order to solve the problems inherent in the previous invention, the present invention has generally incorporated a unit box assembly (to be later described) therein, and intends to increase the aptitude of the previous invention not only by arranging the instruments in the same position as that of the previous invention to thereby retain those advantages, but also by additionally making it possible to move the mounted position of the instruments outwardly of the backrest and to change the direction of manipulation of the instruments by the operator through movement and rotation in their stored state even after the instruments have been released from their stored state so as to be brought into agreement with the position and posture of the operator.

As shown in Type (b), described above, the movability of rotatability is imparted to a spittoon or a cart independent of the chair device and instruments are mounted to the spittoon or the cart, or a device of the type in which a long arm or an exposed support is added to support the tray table rotatably and instruments attached to the tray table may fit for various positions and postures the operator takes during treatment activity from the viewpoint of the direction in which to manipulate the instruments, but when consideration is given to the effects which the assembly described above produces on the patient when he is not undergoing treatment, namely the unshapely sagging of flexible connection pipes connected to the instruments, the presence of an arm and a support which is offensive to the eye of the patient and within his reach, wariness and terror caused by the presence of the arm and the support, and in turn, additional members which may interfere with the space used by the operator during treatment activity. It will become apparent from a description to be given hereinafter that the advantages of the present invention can be evaluated in distinction from those of the prior art treatment chairs of the type described.

A description will now be given of the treatment chair system of the present invention with reference to the drawings showing embodiments thereof.

DETAILED DESCRIPTION OF THE INVENTION

Figure 1:
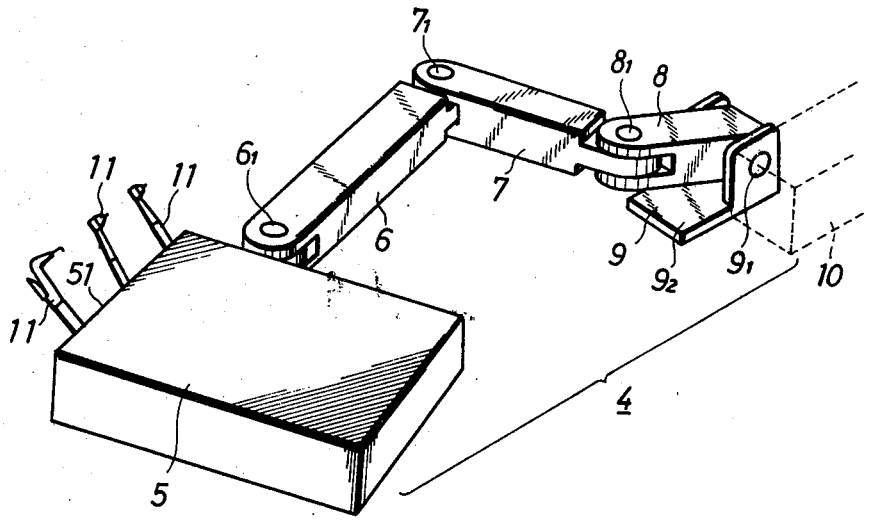
FIG. 1 is a perspective view of a unit box assembly of the invention.
Figure 2:
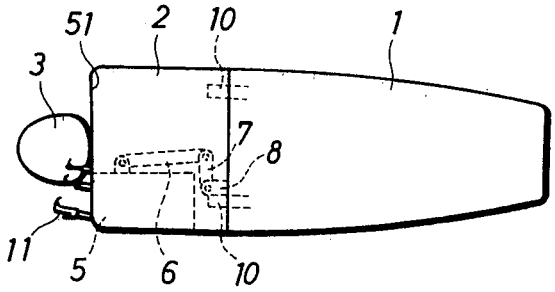
FIG. 2 is a plan view of a dental treatment chair system showing the unit box assembly being stored on the left side of the backrest facing the front of the chair system.

In the invention, a unit box assembly 14 is mounted to the inside or the underside (inside a backrest 2 in the case of the system shown) of a backrest 2 tiltable with respect to a seat 1 of the treatment chair system so as to permit free storing in and drawing out of the backrest 2. This assembly 4 includes a unit box 5, rotary arms 6, 7, 8 and an arm support 9 as shown in the embodiment in FIGS. 1 through 11. More particularly, the assembly includes, in addition thereto, various instruments 11, 11 . . . from the top 51 of the unit box 5 together with flexible connection pipes 12, 12 . . . respectively connected thereto in a freely drawable and retractable manner over the desired lengths of the pipes and, to this end, the unit box 5 incorporates therein a drawing and retraction means (not shown) for the flexible connection pipes 12 . . . including pulleys. A control device (not shown) for supplying electricity and fluid such as air, water, medical solution, mist, etc. to the connection pipes 12 . . . freely continuously and discontinuously may be mounted either inside the box 5 or may be housed in a seat 1 or other base portion 13. The connection pipes 12 . . . and control device and/or fluid source may be connected to each other by housing separate flexible tubes (not shown) in or extending the same along the arms 6, 7, 8. The unit box 5 is mounted in a horizontal position rotatably by a vertical shaft $6_1$ to a first arm 6; the first arm 6 is mounted in a horizontal position rotatably by a vertical shaft $7_1$ to a second arm 7; the second arm 7 is mounted in a horizontal position rotatably by vertical shaft $8_1$ to a third arm 8; the third horizontal arm 8 is in a vertical position rotatably mounted to an arm support 9 by a horizontal shaft $9_1$ and the support 9 is provided with a horizontal piece $9_2$ bearing the third horizontal arm 8 horizontally. The arm support 9 is fixed to a support member 10 protrudently provided on the backside of the seat 1.

For the details of the drawing and retraction means in the unit box 5 and for the details of a cartridge system sheath in the box 5, reference can be made respectively to the disclosure of Japanese Utility Model Publication No. 40626/1977 and to the disclosure of Japanese Patent Publication Laid Open to Public Inspection No. 96296/1978 and accordingly a detailed description of the means and the sheath is omitted.

Since the unit box assembly 4 is of the construction described above, it will be understood that the unit box 5 is horizontally rotatable around three vertical shafts $6_1$, $7_1$, and $8_1$ through the arms 6 and 7, and that the box is vertically rotatable around one vertical shaft $9_1$ thorugh the arm 8 (but is stopped from its rotation in a horizontal state by the support 9). In order to store the unit box assembly 4 neatly in the backrest 2, the backrest 2 is provided on the backside thereof with a storing recess 14. The unit box assembly 4 stored in the backrest 2 on the left side facing the front of the chair from the ordinary treatment position of an operator as shown in detail in the plan view in FIG. 2 and the top 51 of the box 5 is in registry with the shoulder of the backrest in such a manner that the instruments 11 . . . are positioned in the space of the shoulder of the backrest 2, in the space of the side of the headrest 3 or in the space of both the shoulder and the side so as to follow the concept of Japanese Pat. No. 444604 and to retain the convenience for the operator in treatment.

A description will now be given of how the unit box assembly 4 is associated with the tilting of the backrest 2. When the backrest 2 is raised from the state in FIG. 3 to the state in FIG. 6 with the unit box 5 retained on the backside of backrest 2 as by hooks (the state is called a stored state), the arm 8 follows the raising of the backrest 2 and pivots around a horizontal shaft 9 to bring about a state shown in FIG. 6. In order to show such an operation, the horizontal shaft 9 is arranged on substantially the same line as a tilting shaft (not shown) of the backrest 2. In this state, the unit box 5 is freely movable and rotatable within the storing area of plane by expansion, contraction, horizontal and vertical rotation of the arms 6, 7 and 8.

Figure 5:
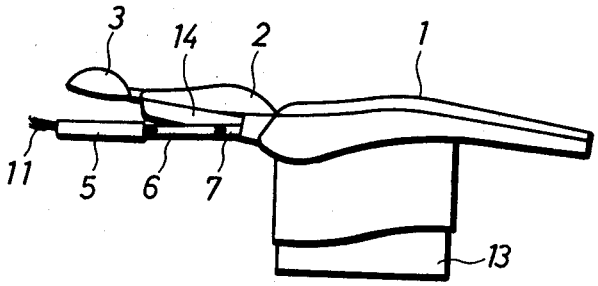
FIG. 5 is a side view of the chair system shown in FIG. 4.
Figure 6:
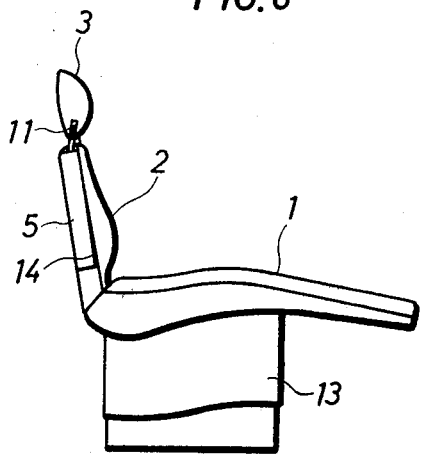
FIG. 6 is a side view of the state of the backrest being raised from the FIG. 3 position.
Figure 7:
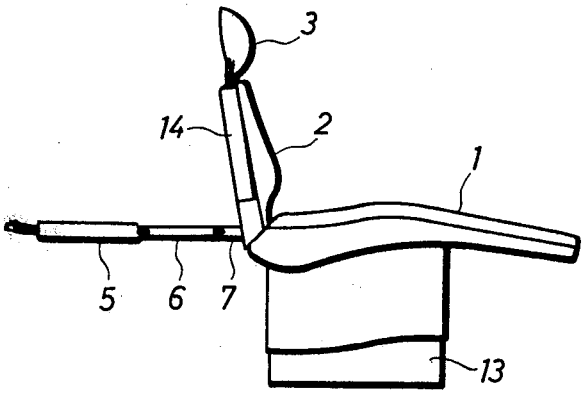
FIG. 7 is a side view showing the state of the unit box assembly being released from its storage in the backrest in the FIG. 6 state.
Figure 8:
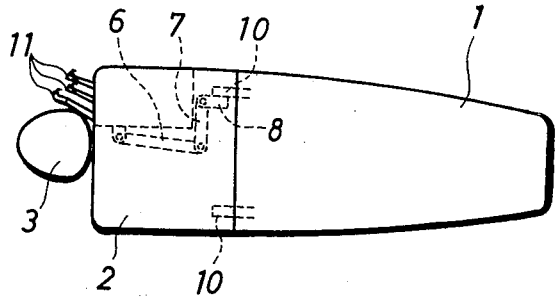
FIG. 8 is a plan view of the chair system showing the state of the box unit assembly being stored in the right side of the backrest facing the front of the chair system.
Figure 9:
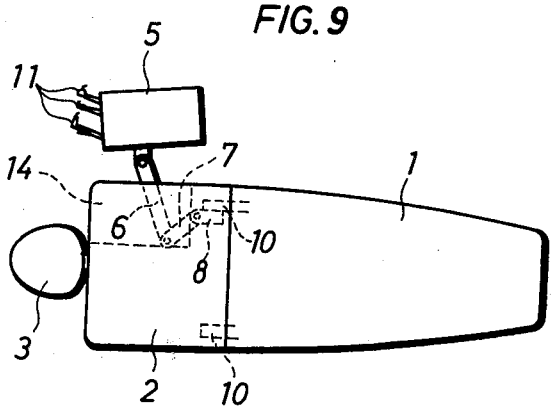
FIG. 9 is a plan view of the state of the unit box assembly being moved out from the FIG. 8 position to the outside of the backrest.
Figure 10:
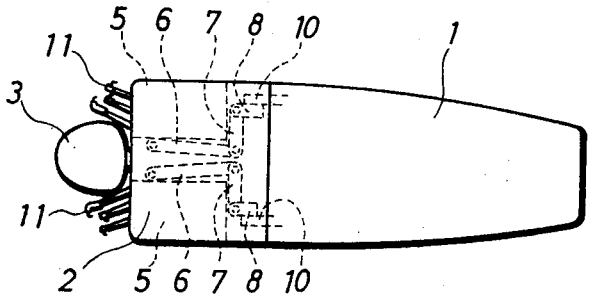
FIG. 10 is a plan view of the chair system showing the state of the unit box assembly being stored both in the right side and in the left side of the backrest.
Figure 11:
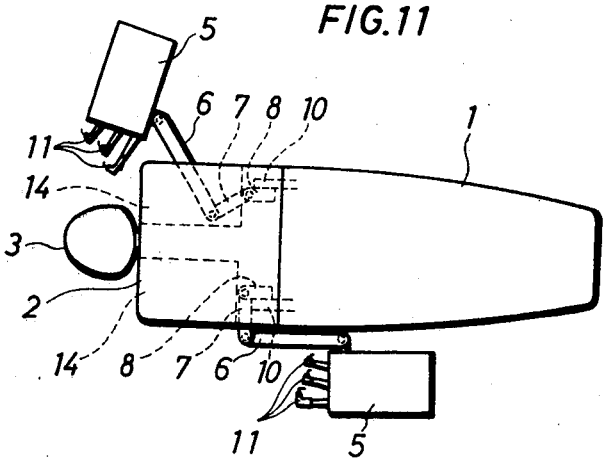
FIG. 11 is a plan view showing the state of both unit boxes being moved out from the backrest.

When the unit box 5 is moved away from the backrest 2 (when the box 5 is released from its stored state), the box 5 falls of its own weight in accordance with the vertical rotation of the arm 8 but is supported and stopped horizontally by a horizontal block $9_2$ of the arm support 9 and is brought from a state in FIG. 6 into a state in FIG. 7. This means that even when the unit box 5 is released from the backrest 2 placed in its horizontal position in FIG. 3, the box 5 is held horizontal as shown in FIG. 5. In short, in the example illustrated, the unit box assembly 4, when held stored in the backrest 2, follows the tilting of the backrest 2, but when released from storage, the assembly is always held horizontal irrespective of the tilting of the backrest 2. Accordingly, after the assembly 4 has been held horizontal, the unit box 5 can be moved to a position fit for the position and posture which the operator takes for treatment by horizontal rotation of the first arm 6 and second arm 7.

Figure 4:
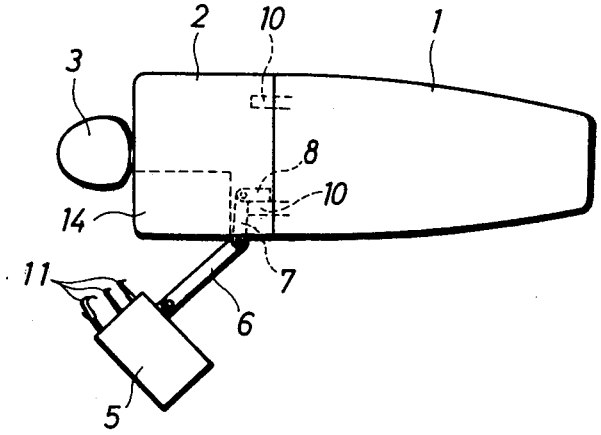
FIG. 4 is a side view showing the state of the unit box assembly being drawn out from the state in FIG. 2 to the outside of the backrest.
Figure 3:
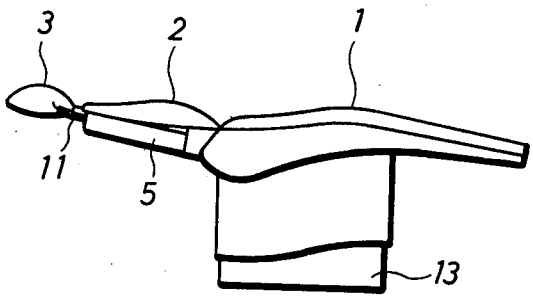
FIG. 3 is a side view of the chair system shown in FIG. 2.
Figure 12:
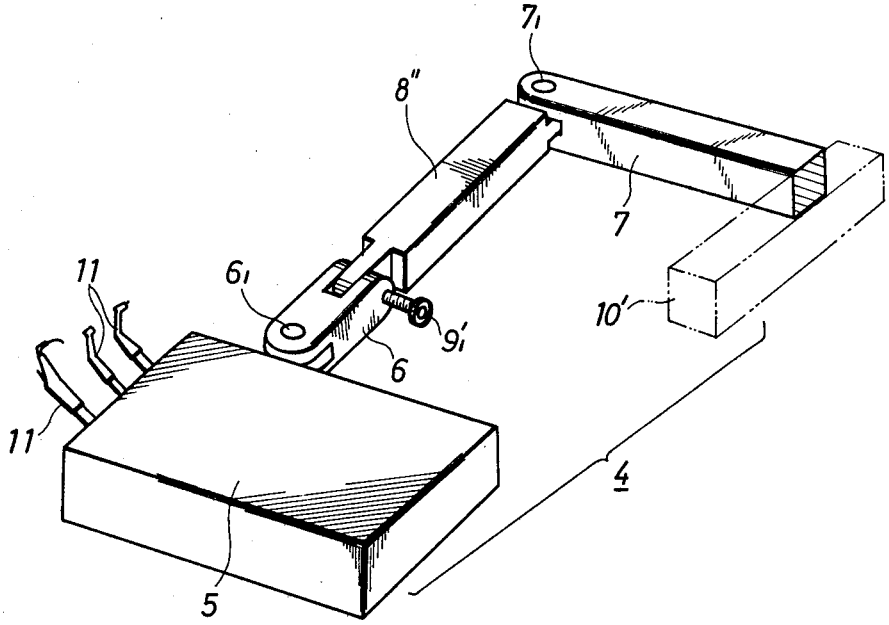
FIG. 12 is a perspective view of a unit box assembly showing another embodiment of the invention.
Figure 13:
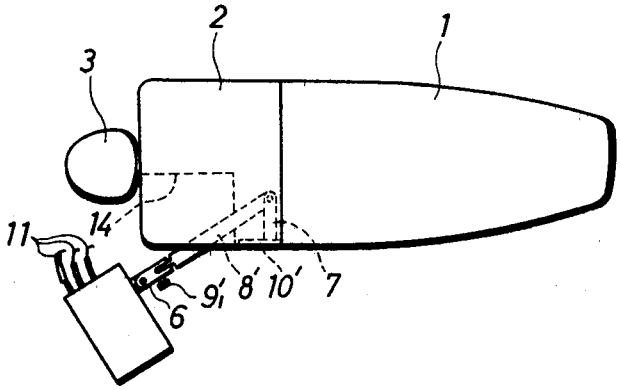
FIG. 13 is a plan view showing the state of the unit box assembly being drawn out from the backrest.
Figure 14:
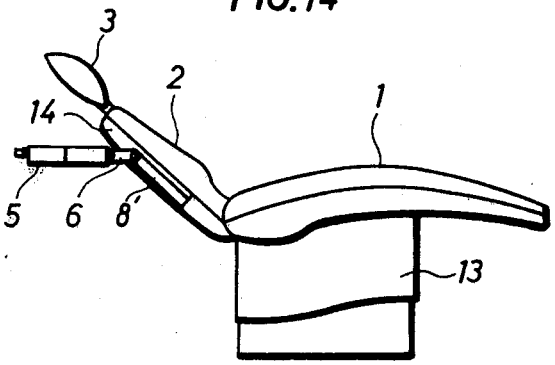
FIG. 14 is a side view of the assembly in the FIG. 13 position.

Shown in FIG. 4 is an example of the state in which the unit box 5 is drawn out from its stored state in the backrest to an exposed state. In the example, the unit box 5 is provided inside the backrest 2 corresponding to the left of the chair, but an example in which the unit box 5 is provided on the right side of the backrest 2 for convenience of a left-handed operator (or a nurse or an assistant) and the state of the box 5 being drawn out from the backrest 2 are shown respectively in FIGS. 8 and 9. Furthermore, an example in which two box units 5 are mounted on the right and left sides of the backrest 2 and the state of the box units 5 being drawn out from the backrest 2 are respectively shown in FIGS. 10 and 11. In another embodiment of the invention shown in FIGS. 12 and 14, the unit box assembly 4 is designed not only to be stopped and held horizontal in its vertical rotation after the assembly 4 has been drawn out from the backrest 2 in the same manner as in the preceding embodiment but also to be enlarged in its area of vertical rotation and to be stopped in its vertical optionally tilted position including a horizontal position. Namely, the unit box assembly 4 of this embodiment comprises a horizontal rotary arm 6, a vertical rotary arm 8′ designed to be freely vertically rotated and stopped with respect to the arm 6 by an adjusting screw $9_1'$, a horizontal arm 7 secured in a horizontal position movably to the arm 8′, and a frame 10′ provided inside the backrest 2 for fixedly supporting one end of the arm 7. When this embodiment is compared with that of FIG. 1 it is apparent that the vertical rotary arm 8 in FIG. 1 is different from this embodiment in that the arm 8 in the preceding embodiment is in this embodiment interposed between the horizontal arms 6 and 7 and one end of the horizontal arm 7 is directly supported on the backrest 2. This difference takes shape in the fact that when the adjusting screw $9_1'$ is loosened, the arm 6 and the arm 8′ are brought into a vertically rotatable relation with each other in such a manner that if one arm is a fixed side, the other arm becomes a rotatable side. It is apparent that this vertical rotatability increases the area of vertical swing of the box 5 over the embodiment in FIG. 1 and makes it possible to stop the box 5 in any desired place by use of the screw $9_1'$. Both embodiments are the same in respect to horizontal movability. For clarity of the relevance with respect to the arm and pivot in FIG. 12, the members that are the same as those in FIG. 1 are designated by the same or primed reference characters. FIGS. 12 and 14 show respectively a plan view and a side view of the treatment chair device in which the unit box assembly of the second embodiment corresponding to FIGS. 4 and 7 of the first embodiment is used.

As apparent from the above description, the second embodiment provides a greater variety of directions for manipulation of instruments 11 in response to the postures of the operator during treatment.

Figure 15:
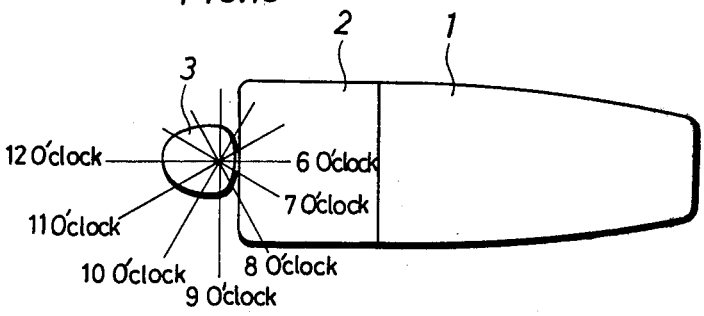
FIG. 15 is a plan diagram showing the treatment position of the operator after the fashion of a clockface with respect to the treatment chair.

A description will now be given of how the box unit assembly of the invention can be adapted for a particular position of the operator during treatment by comparison with the Japanese Pat. No. 444604. Before making the comparison between the two, various positions of the operator for treatment are described briefly, in the fashion of a clockface with reference to FIG. 15. When a medium line of a headrest 3 is brought into line with a line of 12 to 6 o'clock, a semicircular area below the line corresponds to 11, 10, 9, 8, and 7 o'clock. The operator generally takes a seated position in the 12 o'clock position, but depending upon circumstances, he may first find it necessary to carry out treatment in the 9 o'clock position. Of course, he may possible move to the mid-position between 12 and 9 o'clock. When the operator shifts from his seated position to an upright position, the backrest 2 moves from a horizontal to an erect position and the operator is seated off to the left of the backrest 2. The position and posture of the operator for treatment in which the invention displays its usefulness to the fullest extent is in the seating positions of 12 to 9 o'clock (particularly 9 o'clock). A description will hereinafter be given of this fact.

Figure 16:
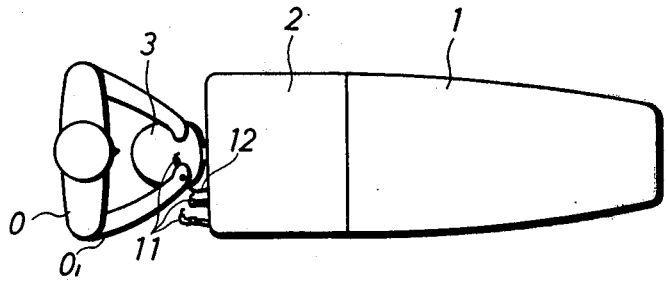
FIGS. 16 and 17 are operation diagrams in various treatment positions and postures of the operator using the conventional dental treatment chair, FIG. 16 being a plan view in the 12 o'clock position, and FIG. 17 being a plan view in the 9 o'clock position.
Figure 18:
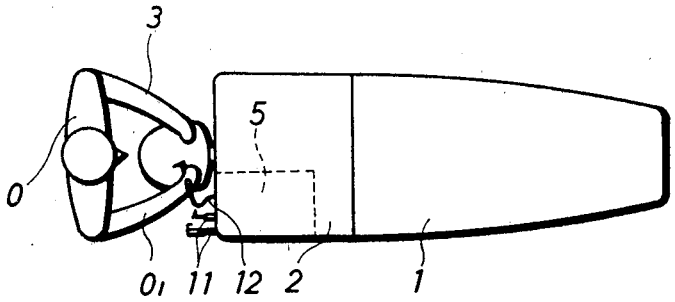
FIGS. 18 and 19 are diagrams illustrating various positions and postures which the operator takes using the chair system of the invention corresponding to those FIGS. 16 and 17.

(1) Seating position at 12 o'clock:

As apparent from comparison between FIGS. 16 and 18, when the operator is in this position and posture, instruments 11 . . . are in the space on the shoulder of the backrest 2 on the side of the headrest 3 and in the space area of the shoulder and the side, and not only can the operator o freely draw and retract the instruments 11 . . . closest to the mouth of a patient but also flexible connection pipes 12 are placed outside the area of movement of a right arm $o_1$ of the operator o, with the result that the therapeutic effect which the present invention can produce is entirely the same as in the previous invention.

Figure 17:
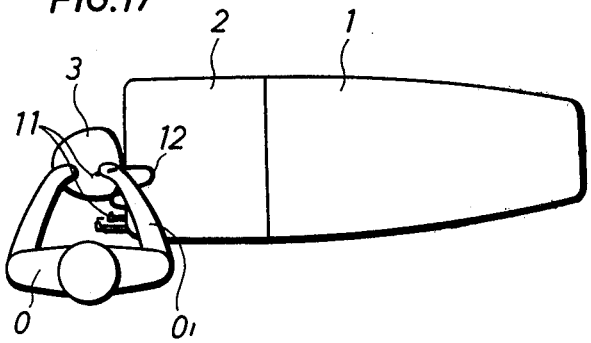
Figure 19:
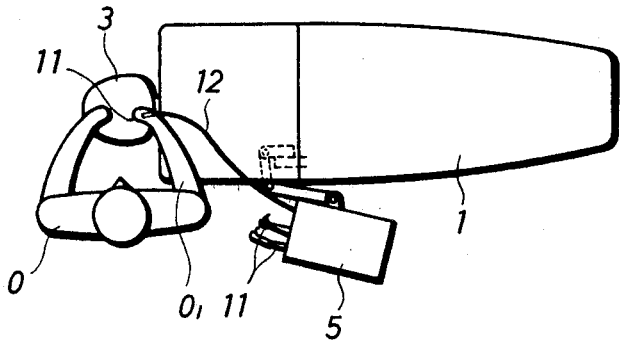

(2) Seating position at 9 o'clock:

In the box unit assembly according to the previous invention in FIG. 17, when the instrument is drawn out, the flexible connection pipe 12 is suspended in the state of the pipe twining around the right hand $o_1$, and accordingly the pipe 12 interferes with the operation and visual field of the operator when treatment is carried out by the right hand $o_1$. In contrast thereto, in the present invention, as shown in FIG. 19, when the unit 5 is arranged as shown, it is possible to carry out treatment without the pipe 12 entwining around the right hand $o_1$ and accordingly the invention is far more advantageous than the previous invention.

It will be understood that the embodiments illustrated are merely one form of the invention shown by way of example and many other modifications of the invention which can be adapted for the position and posture for treatment may be made without departing from the scope and spirit of the invention.

As apparent from the description above, the invention not only retains the advantages of the previous invention by storing the unit box having instruments mounted drawably and retractably from the top thereof in the inside (or underside) of the backrest and normally placing the instrument mounting portion of the unit box in the space on the shoulder of the backrest, on the side of the headrest or both on the shoulder and on the side, and also provides the new advantage that when the unit box is released from its stored position and after it has been drawn out from the backrest, the box can be freely moved, rotated vertically and bilaterially and stopped independently of tilting of the backrest. Accordingly, the box does not interfere with treatment operation even in the seated positions of 12 to 9 o'clock.

The invention has an additional advantage in that when the unit box is not drawn out from the backrest, the box is stored and concealed on the inside or the underside of the backrest and even when it is drawn out, the box is held in a preset state suited for treatment and is pleasing in appearance, does not interfere with the sphere of activity of the operator, does not cause any uneasiness or anxiety on the part of the patient and can save additional space for the box.

We claim:

1. A dental treatment chair system having a chair seat, a backrest tiltably mounted to said seat, and a headrest, said system comprising:

at least one unit box assembly connected to said backrest and equipped with a number of dental instruments and flexible connective pipes therefor;

connecting means for allowing said box assembly to be pulled out into any direction from a storage position coextensive with said backrest and to be moved back into said storage position; and a means for interlocking said box assembly with tilting motions of said backrest and for releasing said box assembly from said tilting motion whereby said box assembly tilts together with said backrest when said box assembly is interlocked with said backrest and said box assembly is freely movable independent of said backrest when released from said backrest.

2. A dental chair system according to claim 1, wherein said backrest comprises a frame to store said box assembly.

3. A dental chair system according to claim 1 or 2, wherein said connection means comprises a combination of at least one arm rotatable in the horizontal direction, at least one arm rotatable in the vertical direction and support members therefor.

4. A dental chair system according to claim 1 or 2, wherein said connecting means includes a screw for adjusting movement of said arms.

5. A dental chair system according to claim 1 or 2, wherein said assembly is provided with means for drawing and retracting said instruments, thereby allowing said connecting pipes for said instruments to extend at a desired length.

6. A dental chair system according to claim 1 or 2, wherein said assembly and said connection means are stored in a space approximately divided by planes substantially including the front and back surfaces of said backrest, respectively, a plane substantially including the top of said headrest, a plane substantially including one of the opposite side surfaces of said headrest, a plane substantially including the upper surface of one of the two shoulder of said chair back, and a plane substantially parallel to a plane including one of the front and back surfaces of said backrest.

* * * * *